US005417584A

United States Patent [19]

Knott

[11] Patent Number: 5,417,584

[45] Date of Patent: May 23, 1995

[54] FLAT CABLE/CONNECTOR STRAIN RELIEF CONNECTION AND METHOD THEREOF

[75] Inventor: Bradley Knott, Phoenix, Ariz.

[73] Assignee: W. L. Gore & Associates, Inc., Newark, Del.

[21] Appl. No.: 213,291

[22] Filed: Mar. 14, 1994

[51] Int. Cl.[6] ..... H01R 13/58

[52] U.S. Cl. ..... 439/460; 439/936; 439/495

[58] Field of Search ..... 439/460, 449, 936, 495, 439/496

[56] References Cited

U.S. PATENT DOCUMENTS

| | | | |
|---|---|---|---|
| 4,382,652 | 5/1983 | Sinclair | 439/471 |
| 4,406,511 | 9/1983 | Hayes | 439/449 |
| 4,798,544 | 1/1989 | Hartman | 439/460 |
| 4,971,574 | 11/1990 | Garcia | 439/497 |
| 5,212,348 | 5/1993 | Gibson | 439/936 |

OTHER PUBLICATIONS

Research Disclosure—vol. 320, No. 50, 10 Dec. 1990, Havant GB, p. 959.

*Primary Examiner*—Gary F. Paumen
*Attorney, Agent, or Firm*—Gary A. Samuels

[57] ABSTRACT

A strain relief connection and method therefor between a connector housing and a flat, elongated cable including a plurality of spaced parallel conductors and insulation integrally encasing the conductors. The connection includes an opening through the insulation having a perimeter defined by the insulation, a section of at least one conductor longitudinally extending across the opening, a coating of the insulation enclosing the section of the conductor, and cured adhesive attached to the connector housing and disposed in the opening to engage the insulation defining the perimeter of the opening, the section of the at least one conductor being embedded in the cured adhesive.

3 Claims, 3 Drawing Sheets

FLAT CABLE/CONNECTOR STRAIN RELIEF CONNECTION AND METHOD THEREOF

BACKGROUND OF THE INVENTION

1. Field of the Invention

This invention relates to mechanical connection between a flat multi-conductor cable and a connector and in particular a strain relief connection and method thereof.

2. Description of Related Art

There are two aspects to connecting a flat multi-conductor cable to a connector. One is the electrical connection between the conductors of the cable and the various pins of the connector. The other is the mechanical connection between the cable and the connector. With respect to the latter, some form of strain relief is generally required to decouple from the electrical connection the mechanical loads that may be imposed along the length of the flat cable.

A standard method of flat cable strain relief is to mechanically clamp the cable insulation between two connector parts or jaws. This method is not particularly effective when the cable insulation has a very low coefficient of friction, such as when the insulation is made of a fluoro-polymer. This method also is limited to a narrow range of cable thickness. Thus, connector jaws for mechanically clamping one cable may have to be changed to a different size to clamp a cable that lies outside of a narrow range of thickness.

Another known strain connection between a flat cable and a connector is adhesive bonding of the cable insulation to the connector housing. This method does not work with some insulations, such as fluoropolymers, that are not easily bonded. With such insulation material, a hazardous etchant must be used to prime the insulation prior to bonding. Moreover, adhesive bond strengths to most insulation materials are typically less than that provided by mechanical attachment.

The subject invention provides an improved method of mechanically connecting flat cable to a connector. The connection couples loads imposed on the cable to the connector housing while avoiding strain on the conductors and their electrical connections.

Additional advantages of the invention are set forth in part in the description which follows, and, in part, will be obvious from the description or may be learned by practice of the invention.

SUMMARY OF THE INVENTION

The objects and advantages of the invention may be realized and attained by means of the instrumentalities and combinations particularly pointed out in the appended claims.

The invention is directed to a strain relief connection between a connector housing and a flat, elongated cable including a plurality of spaced, parallel conductors and insulation integrally encasing the conductors. The connection includes an opening through the insulation, the opening having a perimeter defined by the insulation, a section of at least one connector longitudinally extending across the opening, a coating of the insulation enclosing the section of conductor; and cured adhesive attached to the connector housing and disposed in the opening to engage the insulation defining the perimeter of the opening, the section of the at least one conductor being embedded in the cured adhesive.

Preferably, longitudinal sections of a plurality of transversely adjacent conductors extend longitudinally across the opening in the insulation each being enclosed by a coating of insulation and embedded in cured adhesive.

In a preferred embodiment, the connection comprises at least two transversely spaced openings, each opening having a section of at least one conductor longitudinally extending across the opening.

Also in accordance with the invention, a method of mechanically connecting a flat, elongated cable to a connector housing includes the steps of using a laser to remove most of the insulation from a longitudinal section of each of a plurality of transversely adjacent conductors and to leave a coating of insulation on each such section; applying a bead of adhesive to the connector housing; embedding the adjacent longitudinal sections in the adhesive; and curing the adhesive. In the method and connection of the invention, preferably the adhesive does not adhere to the insulation.

BRIEF DESCRIPTION OF THE DRAWINGS

The accompanying drawings, which are incorporated in and constitute a part of this specification, illustrate an embodiment of the invention and, together with the description, serve to explain the principles of the invention.

DESCRIPTION OF THE PREFERRED EMBODIMENT

Reference will now be made in detail to the present preferred embodiments of the invention, examples of which are illustrated in the accompanying drawings.

The invention is directed to a strain relief connection between a connector housing and a flat, elongated cable having a plurality of spaced, parallel conductors and insulation integrally encasing the conductors.

Figure 1:
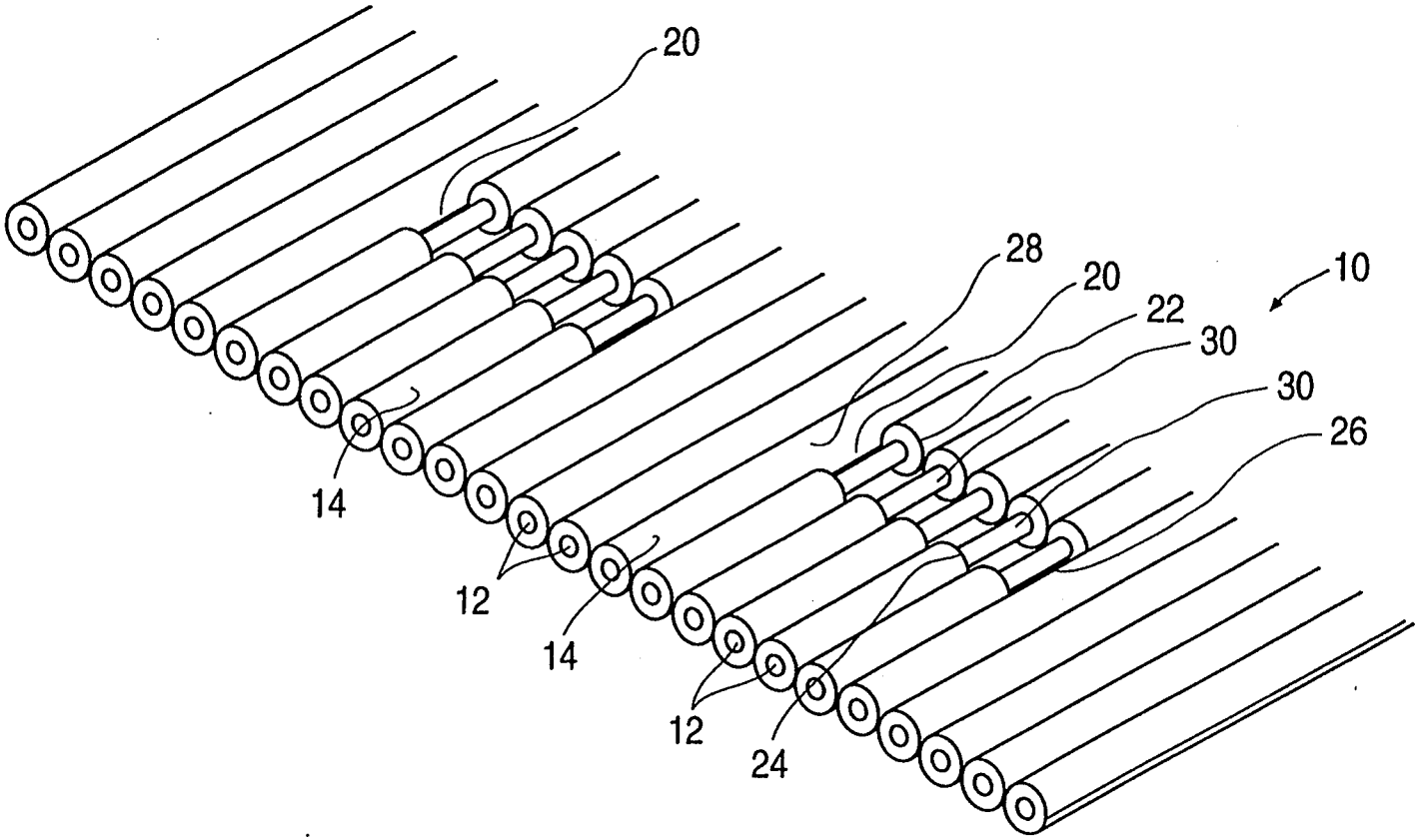
FIG. 1 is a perspective view of a flat, multi-conductor cable with insulation removed to define windows therein.
Figure 2:
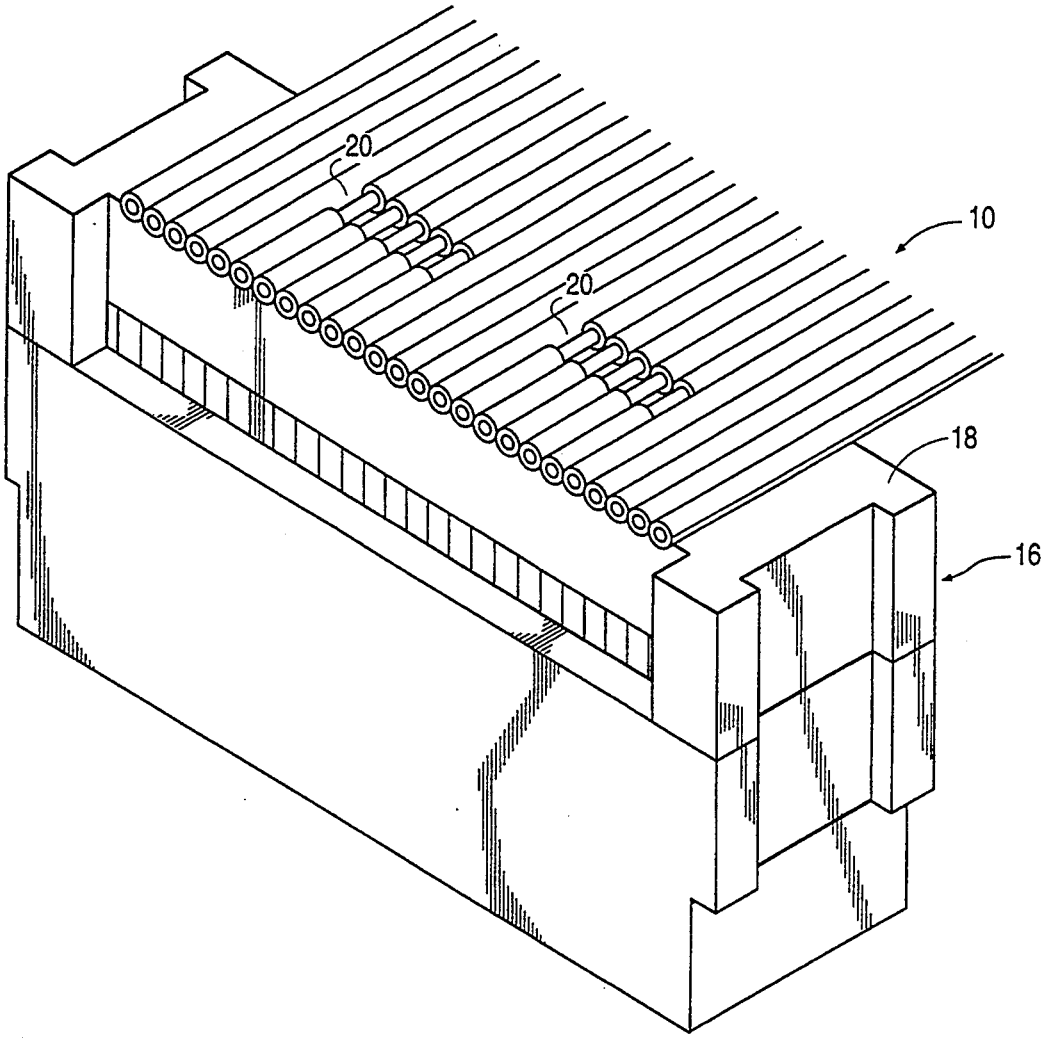
FIG. 2 is a perspective view of the flat cable with windows formed therein disposed proximate a connector.

As depicted in FIGS. 1 and 2, flat elongated cable 10 includes a plurality of spaced, parallel conductors 12 and insulation 14 integrally encasing conductors 12 in their respective parallel relationships. As depicted in FIG. 2, the connector 6 includes housing 18 to which cable 10 is to be mechanically connected.

The strain relief connection includes an opening through the insulation, the opening having a perimeter defined by the insulation. In the embodiment depicted in FIG. 1, opening 20 through insulation 14 has a perimeter defined by insulation 14. In particular, opening 20 includes transversely extending walls 22, 24 and longitudinally extending walls 26, 28.

The strain relief connection of the invention further comprises a section of at least one conductor longitudinally extending across the opening. As embodied herein and depicted in FIG. 1, a plurality of sections 30 of conductors 12 longitudinally extend across opening 20.

Preferably, two or more openings are disposed in spaced relation transversely across the cable. While one opening whether exposing a section of one cable or not, might be sufficient to provide a strain relief mechanical connection, better connection is achieved with multiple openings, each exposing a plurality of cable sections to be embedded in the cured adhesive.

The strain relief connection further includes a coating of the insulation enclosing the section of the conductor extending across the opening. Each section 30 of conductor 12 depicted in the embodiment of FIG. 1 extending across opening 20 is coated with some of the insulation 14. The term "coating" as used herein is intended to mean a layer of insulation of a thickness substantially less than that of the cable. Preferably, when the insulation is removed, a portion of the insulation is retained on each of the conductors. The insulation coating aids in preventing adhesive from bonding to the conductor itself and thereby reduces conductor constraint and subsequent material fatigue during flexure of the conductors.

Figure 3:
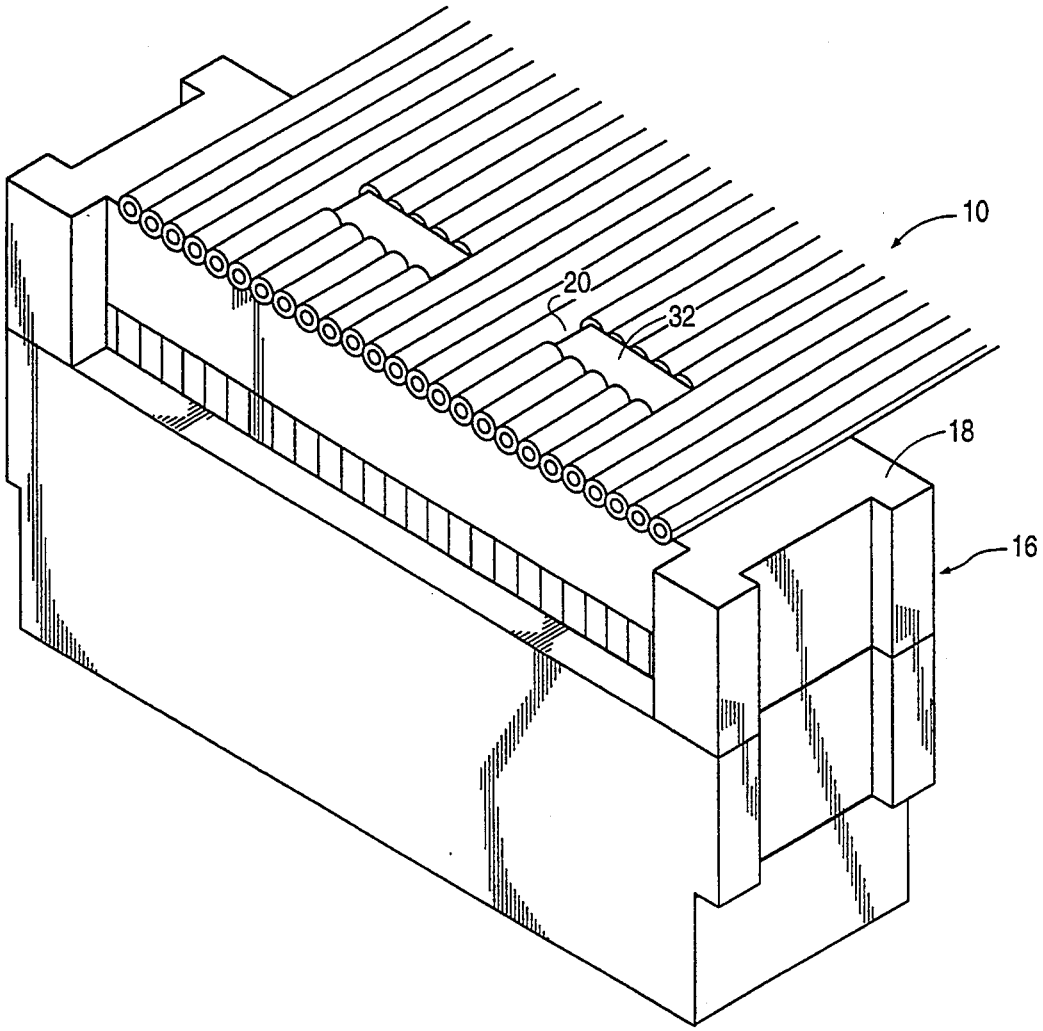
FIG. 3 is a perspective view of the flat cable in place on a connector with cured adhesive engaging the insulation perimeter of the windows.

The strain relief connection finally includes cured adhesive attached to the connector housing, and disposed in the opening to engage the insulation defining the perimeter of the opening, the section of conductor being embedded in the adhesive. As embodied herein and depicted in FIG. 3, adhesive 32 is bonded to the connector housing 18 and is disposed in opening 20 to engage insulation 14 at the perimeter walls 22, 24, 26, 28 of opening 20. The sections 30 of conductors 12 which extend across opening 20 are embedded in the adhesive.

In operation, once the adhesive 32 cures, it becomes structurally integral with connector housing 18, and, even though the adhesive may not adhere to the insulation, the cured adhesive fills opening 20 engaging the perimeter walls 22, 24, 26, 28 thereby transferring forces imposed on insulation of flat cable 10 through the cured adhesive 32 to connector housing 18. Because of the coating of insulation on sections 30 of conductor 12 in openings 20, forces on cable 10 are not transferred through adhesive 32 to conductors 12.

The method of the invention is directed to mechanically connecting a flat, elongated cable to a connector housing, the cable including a plurality of spaced, parallel conductors and insulation integrally encasing the conductors. The method comprises the steps of removing most of the insulation from the mid portion of the cable to form a window therein exposing the longitudinal section of at least one conductor, the conductor section retaining a coating of insulation. As embodied herein, and as depicted in FIG. 1, the elongated cable 10 includes a plurality of spaced, parallel conductors 12 and insulation 14 integrally encasing conductors 12. Insulation 14 is removed from a mid-portion of the cable 10 to form window 20. The term "mid-portion" refers to a location remote from either end of cable 10.

In a preferred embodiment, the insulation is removed from cable 10 to create window or opening 20 by means of a 20 watt carbon dioxide laser of a known type. The laser removes insulation 14 from conductors 12 to define opening or window 20. Because conductors 12 conduct the heat of the laser away during the cutting or removing process, a portion or coating of insulation 14 is retained on each section of conductor 12 exposed across window or opening 20.

The method of connecting the cable to the connector housing of the invention further comprises applying a bead of adhesive to the connector housing. Although not depicted in FIG. 2, a bead of adhesive is applied on housing 18 in a position where opening or window 20 may be placed in registration with the bead of adhesive.

In accordance with the invention, when placing cable 10 on connector housing 18 with the window or opening 20 in registration with the bead of adhesive, each conductor section 30 is embedded in adhesive 32 and the adhesive engages or contacts the insulation 14 forming the perimeter of window or opening 20.

Finally, in accordance with the method of the invention, the adhesive is cured to form a relatively rigid mechanical connection between insulation 14 of cable 10 and connector housing 18 while avoiding imposing strains on conductors 12.

Any number of known adhesives may be used, such as an epoxy resin sold under the brand EccoBond 45/15 by Emerson Cuming, Inc. While the connection and the method may be used with any flat cable, it is particularly useful with cable having insulation to which adhesive does not readily bond, such as polyvinylchloride, "Teflon" (polytetrafluoroethylene), and expanded polytetrafluoroethylene.

It will be apparent to those skilled in the art that various modifications and variations could be made to the connection and to the method of the invention without departing from the scope or spirit of the invention.

What is claimed is:

1. A strain relief connection between a connector housing and a flat, elongated cable including a plurality of spaced, parallel conductors and insulation integrally encasing the conductors, the connection comprising:

an opening through the insulation, the opening having a perimeter defined by the insulation;

a section of at least one conductor longitudinally extending across the opening;

a thin coating of the insulation enclosing the section of conductor; and cured adhesive attached to the connector housing, and disposed in the opening to engage the insulation defining the perimeter of the opening, the section of the at least one conductor being embedded in the cured adhesive.

2. The connection of claim 1 wherein a plurality of transversely-adjacent conductors extend across the opening.

3. The connection of claim 1 comprising at least two transversely-spaced openings in the cable, each opening having at least one conductor section extending across it.

* * * * *